US005107806A

United States Patent [19]

Döhring et al.

[11] Patent Number: 5,107,806

[45] Date of Patent: Apr. 28, 1992

[54] HYDRAULIC VALVE-CLEARANCE COMPENSATING ELEMENT FOR INTERNAL COMBUSTION ENGINES

[75] Inventors: Klaus Döhring, Gorxheimertal; Volker Budde, Grosskarlbach, both of Fed. Rep. of Germany

[73] Assignee: Firma Carl Freudenberg, Weinheim/Bergstr., Fed. Rep. of Germany

[21] Appl. No.: 748,272

[22] Filed: Aug. 21, 1991

[30] Foreign Application Priority Data

Aug. 24, 1990 [DE] Fed. Rep. of Germany ..... 4026793

[51] Int. Cl.[5] ..... F01L 1/24

[52] U.S. Cl. ..... 123/90.55; 123/90.58; 74/569

[58] Field of Search ..... 123/90.19, 90.48, 90.49, 123/90.52, 90.53, 90.55, 90.58, 90.59; 74/569

[56] References Cited

U.S. PATENT DOCUMENTS

| | | | |
|---|---|---|---|
| 4,191,142 | 3/1980 | Kodama | 123/90.55 |
| 4,438,739 | 3/1984 | Arai et al. | 123/90.55 |
| 4,535,734 | 8/1985 | Kodama et al. | 123/90.55 |
| 4,590,899 | 5/1986 | Kowal et al. | 123/90.55 |
| 4,610,225 | 9/1986 | Camosso et al. | 123/90.55 |
| 4,649,875 | 3/1987 | Mirone et al. | 123/90.55 |
| 4,688,526 | 8/1987 | Buente et al. | 123/90.55 |
| 4,815,425 | 3/1989 | Deuring et al. | 1213/90.58 |
| 4,825,824 | 5/1989 | Deuring et al. | 123/90.58 |

FOREIGN PATENT DOCUMENTS

| | | | |
|---|---|---|---|
| 3528348 | 2/1987 | Fed. Rep. of Germany | 123/90.55 |
| 192811 | 10/1985 | Japan | 123/90.55 |

*Primary Examiner*—E. Rollins Cross
*Assistant Examiner*—Weilun Lo
*Attorney, Agent, or Firm*—Kenyon & Kenyon

[57] ABSTRACT

A hydraulic valve-clearance compensating element for internal combustion engines in which an internal valve stem is capable of being axially shifted relative to an external stem such that, together with the latter, it delimits an oil-filled storage chamber. The volume of the storage chamber may be altered and is sealed to the outside by a gasket. At least one compressible displacement member is included in the storage chamber to offset changes in volume. This displacement member is made of a closed-celled soft foam with a non-porous surface layer.

9 Claims, 3 Drawing Sheets

HYDRAULIC VALVE-CLEARANCE COMPENSATING ELEMENT FOR INTERNAL COMBUSTION ENGINES

BACKGROUND OF THE INVENTION

The invention relates generally to a hydraulic valve-clearance compensating element for internal combustion engines, and more particularly to one of the type in which an internal valve stem is axially shiftable relative to an external stem and, together with the latter, delimits an oil-filled storage chamber, the volume of which may be altered and which is sealed to the outside by a gasket.

A hydraulic valve-clearance compensating element is disclosed in the German Published Patent Application no. 35 06 730. This device contains a storage chamber that is sealed off with respect to the outside by a gasket having a bellows-type construction and which is otherwise inflexibly defined. Its long-term durability is not very satisfactory; the device is particularly subject to gasket damage after a relatively short period of time.

Another valve-clearance compensating element is disclosed by the German Published Patent Application no. 28 47 699. It provides that several swell members be arranged adjacent to one another and incorporate an air cushion, dispersed finely between them. It is noteworthy, however, that both hydraulic fluid as well as a certain component of air are present in the storage chamber. The resultant working properties are not very satisfactory. Another variant provides that the air in the storage chamber be retained by glass spheres or by plastic pearls, or for the swell members to consist of a partially liquid-soaked, sponge-like material help to provide an air cushion, together with the specified component of air. This variant does not properly assure that the air components from the high-pressure chamber are kept out effectively.

The invention is directed to the problem of further developing a valve-clearance compensating element having a storage chamber that is sealed off to the outside, which can be produced cost-effectively and which has an enhanced service life as well as exhibiting improved working properties.

SUMMARY OF THE INVENTION

The invention solves this problem by providing a valve-clearance compensating element in which at least one compressible displacement member is enclosed in the storage chamber to compensate for changes in volume. The displacement member consists of a closed-celled soft foam provided with a non-porous surface layer. Consequently, in the case of the valve-clearance compensating element according to the invention, the gasket between the inner and outer stems is subjected only to those deformations that result from executing the intended task of the gasket.

The presence of a compressible displacement member assures that temperature-dependent changes in the volume of the contained oil and changes in the support length will not cause the shape of the gasket to change. As a result, the premature appearance of leaks is substantially reduced and the service life of the valve-clearance compensating element is prolonged.

One may use a number of displacement members. Where the displacement members are of a very small size, one may provide the storage chamber with a number of displacement members whose aggregate volume corresponds to the volume to be accommodated. The displacement member can be made of a soft foam that is impervious to fluids and which is sealed off from the outside, such as a soft polyurethane foam having a density of 30 to 700 kg/m$^3$.

In manufacturing the device, it is useful to provide the displacement member with a substantially non-porous surface skin. A non-porous surface skin prevents the infusion of oil components into the balloon-like pores of the soft foam body, which are sealed off from the outside, and helps promote a long service life.

The compressible displacement member enclosed in the storage chamber may contain at least one gas-filled cavity and be formed, for example, of a flexible and/or elastically deformable substance made of a polymeric material containing a gas bubble. The size of the displacement member depends on the particular conditions of the application and especially on the anticipated increase in volume that the oil contained in the valve-clearance compensating element experiences as it is heated from room to operating temperature, as well as on any change in volume caused by a change in the support length of the valve-clearance compensating element. Such a change in the support length may, for example, result when a valve remains in the open position when the internal-combustion engine is turned off. In such a case, the valve-clearance compensating element is loaded over a longer period of time by the valve's return spring, which causes the support length to be gradually reduced. Nevertheless, when the internal combustion engine is once again started up, the original support length is restored once the camshaft has made one revolution. The last-mentioned change in volume can result, for example, when a valve is in the open position at the time the internal combustion engine is turned off.

The mechanical stress experienced by the displacement member under normal operating conditions can be reduced by arranging the displacement member in a recess of the inner wall of the storage chamber. The placement of the displacement member in contact (as by adhesion) with the storage chamber's inner wall is advantageous in that it prevents the corresponding area of the adhesion zone of the displacement member from being directly moistened by the oil contained in the storage chamber. Consequently, the corresponding zone of the displacement member is well protected from the physical and chemical effects of the oil contained in the storage chamber. The adhesion can be produced through the use of a secondary adhesive that is introduced in a liquid state into the interstitial zone between the displacement member and the inner wall, and then solidified. When a reactive foam is used, it is possible to produce the displacement member by fabricating it within the recess and connecting it to the recess at the time of fabrication. This enables one to do without the use of a secondary adhesive agent or a secondary shaping tool to produce the displacement member, and is economically advantageous.

In some embodiments the displacement member may be provided with a dynamically balanced configuration. In such cases, one may arrange the displacement member concentrically with respect to the valve-clearance compensating element. This helps avoid damage and any functional impairment which might otherwise result from the unwanted relative displacements of the displacement member.

DETAILED DESCRIPTION

Figure 1:
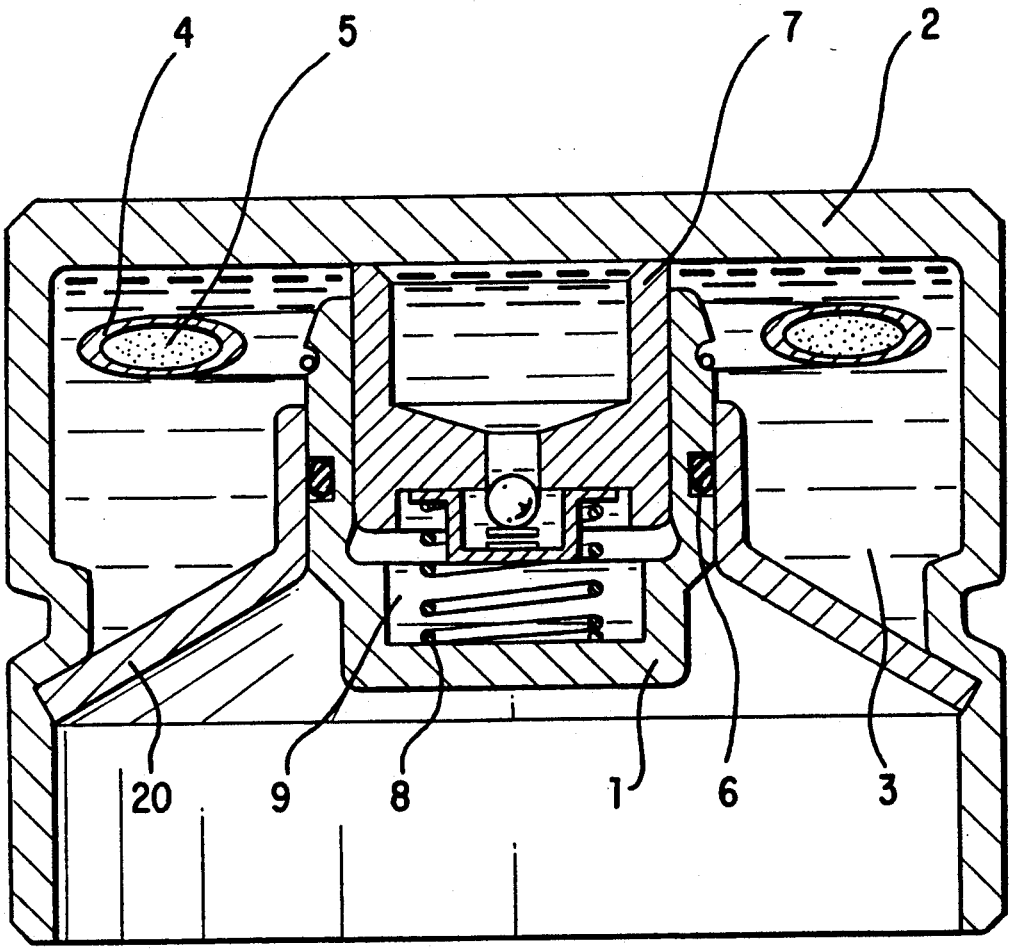
FIGS. 1 through 3 show cross-sectional view of three embodiments of the valve-clearance compensating elements.

FIG. 1 shows a cross-sectional view of the valve-clearance compensating element, which is well suited for use with an internal combustion engine. An internal valve stem 1 is seated so that it is axially displaceable within an external stem 2. The internal stem 1 is braced by means of a compression spring 8 against a piston 7, which abuts the base of the external stem 2. The compression spring 8 has a softer spring rate than the return spring of the corresponding valve of the internal combustion engine (not shown), so that it can not impede the closing action of the valve. This helps provide that the valve disk fits securely in the valve seat when the valve in question is not activated. The force of the compression spring 8 is sufficiently great to provide that the valve-clearance compensating element both properly fits on the valve shaft as well as on the camshaft of the internal combustion engine. If the cam located on this shaft comes into contact with the valve-clearance compensating element, the valve-clearance compensating element and the valve it supports are axially shifted. This shift happens in so short a time that the valve-clearance compensating element exhibits a virtually rigid quality. As a result, the valve is transferred to its open position to an extent which is adequate to permit the desired exchange of gases in the corresponding cylinder of the internal combustion engine.

As the valve is subjected to increased wear, there is a tendency to a gradual relative displacement of the internal stem 1 relative to the external stem 2. However, this does not alter the operational performance of the valve-clearance compensating element.

The cavities surrounded by the internal stem 1, the external stem 2, and the piston 7, are filled with oil. As shown in FIG. 1, the storage chamber 3 is defined by the external stem 2, internal valve stem 1, and a ring 20 extending therebetween. A compressible displacement member 4 is provided in the storage chamber 3. This displacement member is a circular, gas-filled rubber bubble which is arranged concentrically with respect to the valve-clearance compensating element. The bubble is dimensioned to be large enough so that a change in the volume of oil contained in the valve-clearance compensating element due to temperature changes and/or changes in the support length can be accommodated without an increase in pressure that would adversely affect the operation of the device. The movable seal provided by the O-ring gasket 6 is consequently subjected to such stress as is necessary to gradually compensate for valve wear, and not to stresses arising from shifts in oil volume. The resultant relative shifts are so gradual that they are of a very low order of magnitude. This helps the O-ring gasket provide excellent sealing over long periods of use.

Figure 2:
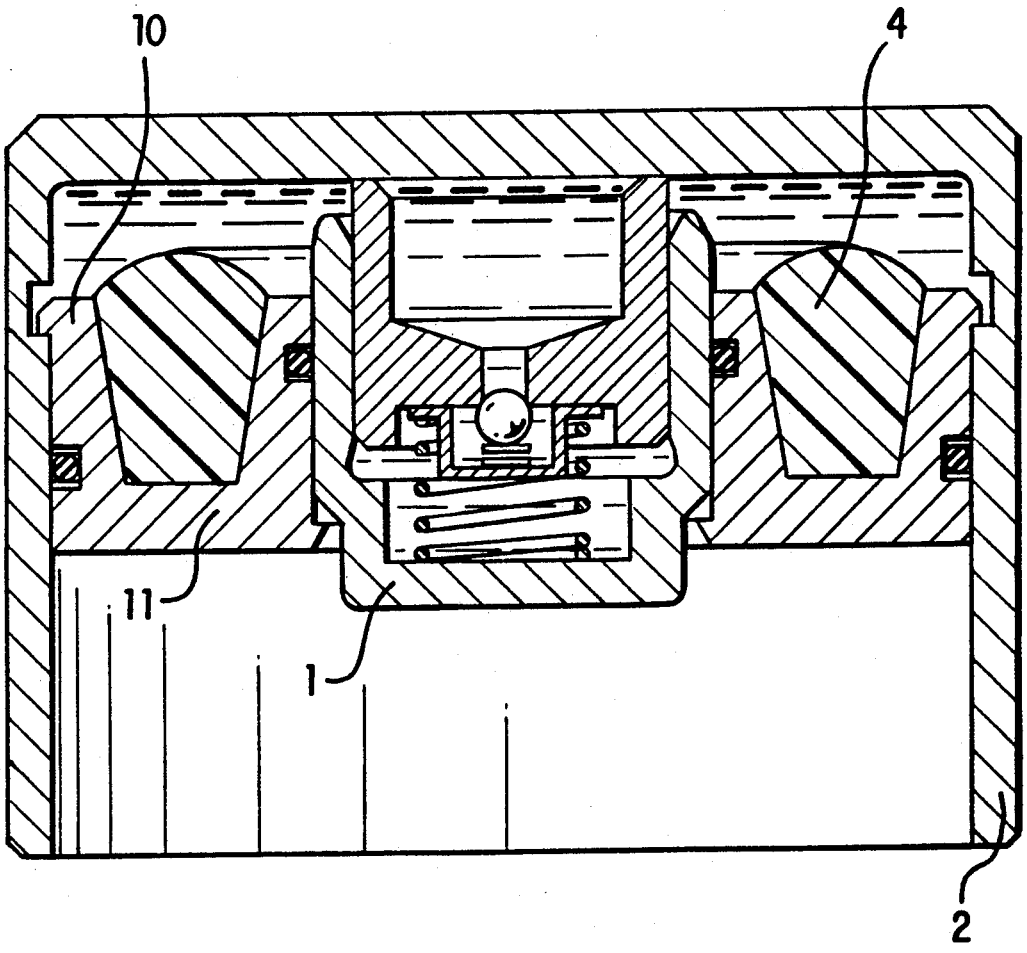

In the case of the embodiment illustrated in FIG. 2, a guide ring 11 made of a hard plastic is arranged between the interior stem 1 and the exterior stem 2. It is sealed off from the exterior stem and from the interior stem in each case by a corresponding O-ring gasket. The outermost position of the guide ring 11 relative to the exterior stem 2 is set by means of an encircling gripping claw 10, which is snapped into an encircling groove of the external stem 2. Alternatively, other fixation means, such as a snap ring, may be used. Overall, the guide ring has a U-shaped profile, which comprises a compressible displacement member 4 in its lower region. The displacement member 4 is made of a closed-celled foam made of polyurethane, silicon, or another polymeric material, which is provided with a casting skin on its outer surface and exhibits an average density of 35 $kg/m^3$. It is likewise possible to use silicon foam or other closed-celled soft foams made of polymeric material. Where necessary, tests should be performed to check the working properties of the material.

The soft foams that are used should have a casting skin on their surface. When the displacement member is produced using the free-foam process, this casting skin is distinguished by its particularly good permeation reliability. In particular, a casting skin produced in the free-foam process thus serves the function of an additional separating membrane.

Figure 3:
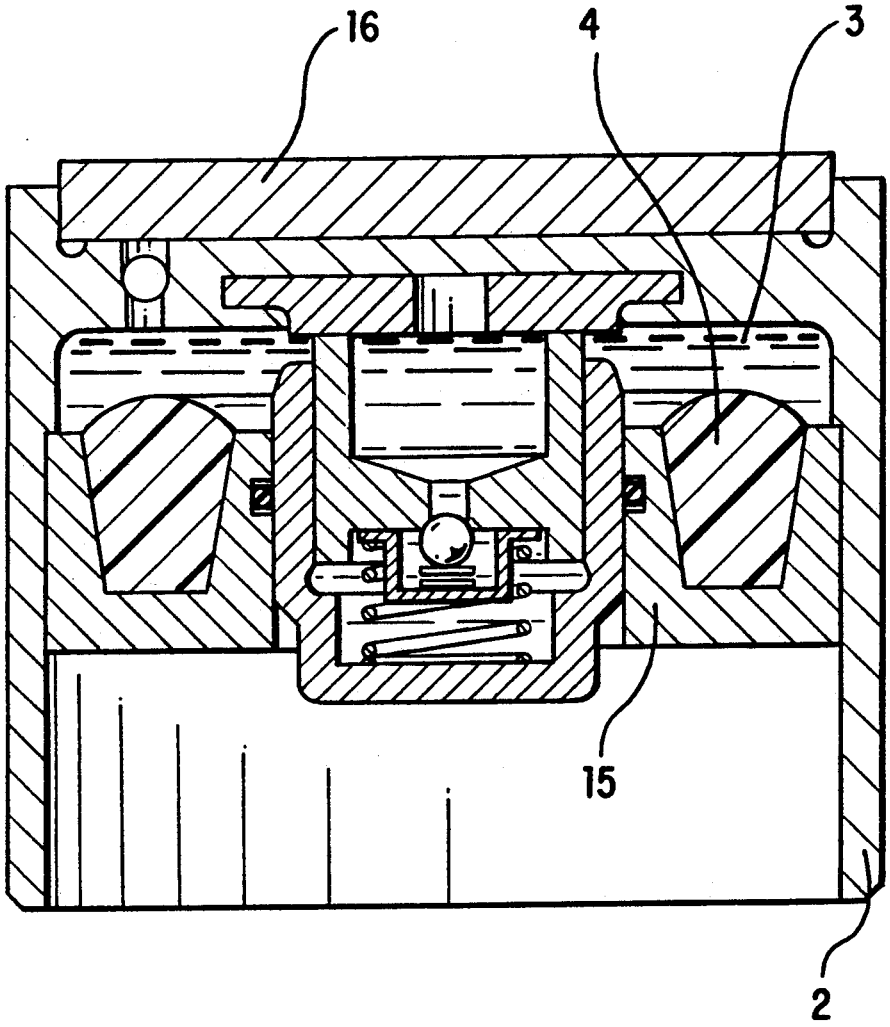

FIG. 3 shows an embodiment similar to FIG. 2, in which the outer stem 2 and ring 15, which accommodates the displacement member 4, are made of plastic. The ring 15, the displacement member 4, and the outer stem 2 are connected to one another by welding or gluing. The displacement member 4, which is made of closed-celled polyurethane foam, can readily absorb the increase in volume that results when there is a temperature-related rise in pressure in the storage chamber 3. An O-ring gasket provides a seal between ring 15 and the internal stem 1. The face of the external stem 2 is glued to an armor plate 16 made of metallic or ceramic material. The embodiment shown in FIG. 3 is of relatively low weight and has excellent durability.

What is claimed is:

1. A hydraulic valve-clearance compensating element for internal combustion engines, comprising:

an external stem;

an internal valve stem capable of being axially shiftable with respect to the external stem;

a ring extending from the external stem to the internal valve stem, whereby said ring, said internal valve stem and said external stem define a hydraulic fluid-filled storage chamber therebetween of variable volume;

a gasket seal between the internal valve stem and the ring; and a compressible displacement member made of closed-celled soft foam having a non-porous surface layer, whereby the displacement member is capable of responding to variations in the volume of the storage chamber by undergoing a change in its volume.

2. The valve-clearance compensating element of claim 1, wherein the soft foam exhibits an average density of 30 to 700 $kg/m^3$.

3. The valve-clearance compensating element of claim 1, wherein the displacement member contains at least one gas-filled cavity.

4. The valve-clearance compensating element according to claim 1, wherein the ring partly defininq the storage chamber has an inner wall that has a recess, and the displacement member is partly arranged in said recess of said inner wall of the ring.

5. The valve-clearance compensating element according to claim 1, wherein the displacement member and an inner wall of the ring are at least partially bonded together.

6. The valve-clearance compensating element according to claim 1, wherein the displacement member has a dynamically balanced configuration and is arranged concentrically with respect to the valve-clearance compensating element.

7. The valve-clearance compensating element according to claim 2, wherein the displacement member has a dynamically balanced configuration and is arranged concentrically with respect to the valve-clearance compensating element.

8. The valve-clearance compensating element according to claim 2, wherein the ring partly defining the storage chamber has an inner wall that has a recess, and the displacement member is partly arranged in said recess of said inner wall of the ring.

9. The valve-clearance compensating element according to claim 4, wherein the displacement member and the inner wall of the ring are at least partially bonded together.

* * * * *